US008384503B2

(12) United States Patent
Hauzenberger

(10) Patent No.: US 8,384,503 B2
(45) Date of Patent: Feb. 26, 2013

(54) MAGNETIC SWITCHING DEVICE

(76) Inventor: Johann Hauzenberger, Sinzing (DE)

( * ) Notice: Subject to any disclaimer, the term of this patent is extended or adjusted under 35 U.S.C. 154(b) by 0 days.

(21) Appl. No.: 13/364,109

(22) Filed: Feb. 1, 2012

(65) Prior Publication Data

US 2012/0126918 A1 May 24, 2012

Related U.S. Application Data

(63) Continuation of application No. PCT/EP2010/062001, filed on Aug. 18, 2010.

(30) Foreign Application Priority Data

Aug. 21, 2009 (DE) ..... 10 2009 038 324

(51) Int. Cl.
*H01H 9/00* (2006.01)

(52) U.S. Cl. ..... 335/207; 335/205

(58) Field of Classification Search ..... 335/207
See application file for complete search history.

(56) References Cited

U.S. PATENT DOCUMENTS

| | | | | |
|---|---|---|---|---|
| 2,827,531 | A | 3/1958 | O'Brien | |
| 3,458,840 | A | 7/1969 | Chapman | |
| 3,597,714 | A | 8/1971 | Brebbia et al. | |
| 3,657,685 | A | 4/1972 | Pfeffer | |
| 4,199,741 | A | 4/1980 | Serrus Paulet | |
| 2002/0093407 | A1 * | 7/2002 | Harris | 335/207 |
| 2010/0109823 | A1 * | 5/2010 | Hauzenberger | 335/207 |

FOREIGN PATENT DOCUMENTS

| | | |
|---|---|---|
| DE | 2104979 | 8/1971 |
| DE | 2749522 | 5/1978 |
| DE | 102006002757 | 2/2007 |
| GB | 124041 | 3/1919 |

* cited by examiner

*Primary Examiner* — Elvin G Enad
*Assistant Examiner* — Lisa Homza
(74) *Attorney, Agent, or Firm* — Simpson & Simpson, PLLC

(57) ABSTRACT

A switching device (1) with a pole element (2) which exhibits a plurality of magnets (10) arranged one next to the other with alternating polarity, a first switching element (4), wherein the pole element (2) is situated next to the first switching element (4) and is movable relative to the first switching element (4), and wherein the first switching element (4) exhibits magnetisable area segments (16). According to the invention the switching device (1) exhibits magnetisable force coupling elements (8), which, in dependence on a relative motion between the pole element (2) and the first switching element (4), are arranged in such a way as to be movable with respect to the switching element.

16 Claims, 7 Drawing Sheets

MAGNETIC SWITCHING DEVICE

CROSS-REFERENCE TO RELATED APPLICATIONS

This application is filed under 35 U.S.C. §120 and §365(c) as a continuation of International Patent Application PCT/EP2010/062001, filed Aug. 18, 2010, which application claims priority from German Patent Application No. 10 2009 038 324.7, filed Aug. 21, 2009, which applications are incorporated herein by reference in their entireties.

FIELD OF THE INVENTION

The present invention relates to a magnetic switching device.

BACKGROUND OF THE INVENTION

From DE 10 2006 002 757 A1 a magnetic storage switch is known. This magnetic storage switch exhibits a pole element which can be rotated about an axis. Furthermore first and second switch plates are provided, wherein the pole element is situated between these two plates. The pole element exhibits a plurality of magnets, which are located with alternating polarity along the circumferential direction of the pole element. Furthermore this magnetic storage switch or the switch plate, respectively, exhibits magnetisable ring segments, between which the pole element is situated, and which are turned with respect to each other by half a step. The switch plates therein exhibit magnetic or magnetisable areas.

A rotation of the pole element causes one of the two switchable elements to be magnetized. The switchable elements are in the form of plates. One of the switchable elements short-circuits the magnetic flux. In this way the two switchable elements can alternately transmit or short-circuit the magnetic flux, so that magnetisable elements like iron plates located next to these switchable elements either are attracted or not.

This device also allows the switching of higher currents and voltages. A disadvantage of this device, however, is that, due to the magnetic forces, rotary motions of the pole element partially are relatively hard.

U.S. Pat. No. 3,597,714 discloses a snap acting magnetic rotary switch having a plurality of switches, each of which comprises two fixed contacts and one movable contact, a permanent magnet being fast with the latter. The switch also comprises two annularly shaped permanent magnets adjacent each other and the magnets fast with said movable contacts, the annular magnet outwardly positioned being fixed and having as many pairs of poles as the switches and as many pairs of poles being provided on the adjacent surface of the intermediate annular magnet, which is fast with a rotary shaft. On the surface of the intermediate annular magnet facing the magnets fast with the movable contacts three ring-shaped poles are provided, the sign of which being alternately different; one of these poles is interrupted at a location and the other two poles are deformed to this location. Upon rotation of said shaft, the switch contacts are snap opened or closed with a speed independent of the speed of rotation of said shaft.

U.S. Pat. No. 2,827,531 discloses a magnetically operated switch which opens and closes solely in response to magnetic forces. At least one plug is adapted to move axially within a stationary support. The plug moves between two rotating disks which are magnetically coded. The electric switch comprises two stationary electric contacts and movable electric contact.

U.S. Pat. No. 4,199,741 discloses a rotary switch with a stationary body and longitudinal bores in each of which a core of magnetic material is movable. Switching means are located at one end of said bores, and adapted to be actuated by the said cores and magnetic elements adapted to be brought successively opposite the ends of said bores to either displace or hold the said cores in the said bores for actuating the said switching means.

BRIEF SUMMARY OF THE INVENTION

Therefore it is an object of the present invention to improve the devices of the prior art in such a way that a rotation of the pole element is easy and constant.

According to the invention, this is achieved by a switching device which comprises a ring shaped pole element having a plurality of permanent magnets in the shape of a segment of a circle and arranged one next to the other with alternating polarity. The permanent magnets d are separated from one another by non-magnetic gaps. The switching device has at least one first switching element and at least one second switching element. The pole element is situated between the at least one first switching element and the at least one second switching element and being rotatable relative to the at least one first switching element and the at least one second switching element. A magnetisable force coupling element is provided with each of the at least one first switching elements and the at least one second switching elements. The first switching element and the second switching element are arranged such in relation to the pole element, so that the first switching element and the second switching element are separated by half a step in a direction of rotation of the pole element and the force coupling elements are movable in a plane in which the pole element moves.

The first and the second switching element exhibit magnetically segments. The magnetisable segments may be in the form of area segments. According to the invention, the switching device exhibits magnetisable force coupling elements which, in dependence on a relative motion between the pole element and the first and second switching element, are arranged in such a way as to be movable with respect to the first and second switching element.

In dependence on a rotation of the pole element relative to the first and second switching element, which can be a switch plate or a plurality of first and second switching elements, the force coupling elements move and for example effect a short-circuit of the magnetic flux. In this way the areas which otherwise become difficult to rotate during the rotation or would be difficult to move during the movement, can be moved more easily.

In an advantageous embodiment the force coupling elements are movable in the plane which is parallel to the plane in which the pole element rotates.

These force coupling elements, for example, can be balls which move, dependent on the position of the pole element with respect to the switching element, preferentially in said plane. However, other types of force coupling elements would be possible, too, for example cylindrical elements and the like.

In a further advantageous embodiment the magnetisable segments of the first and second switching element are separate from each other. Dependent on the rotary position of the pole element relative to the first or second switching element, either a magnetic short-circuit of the pole element is achieved, whereby a corresponding switchable element, like an iron disc, is not attracted, or the magnetic forces are transmitted, leading to a magnetic attraction of the corresponding switchable elements. Advantageously, the magnetisable area segments are separated from each other by non-magnetisable areas.

Thus, for example, magnetisable material could be integrated into a block of copper or a copper disc.

As disclosed by the invention, the first and the second switching elements are separated with respect to each other by half a step. Consequently, an alternating switching of the magnetisable force coupling elements of the first and second switching element is possible. In a further advantageous embodiment, the switching device exhibits a first switchable element, wherein the first switching element is situated between the first switchable element and the pole element. The second switching element is situated between a second switchable element and the pole element. Depending on the rotary position of the pole element with respect to the first and second switching element this switchable element is either attracted or not attracted, as described above. Also, a spring mechanism could be provided, which drives the first or second switchable element away from the first or second switching element, respectively.

In a further embodiment, the first and second switchable elements are movable perpendicular to the direction of motion of the pole element, for example along an axis of rotation of the pole element. It would also be possible, however, that the pole element is linearly displaceable and that the switchable element preferentially is movable in a perpendicular direction.

Preferentially the switching element is stationary and, in a further advantageous embodiment, also the pole element is stationary at least perpendicular to its direction of motion. It would, however, also be possible that the pole element is stationary and the first and second switching elements are movable, for example rotatable.

Advantageously, the pole element is rotatable about a set axis of rotation.

In an advantageous embodiment, the force coupling elements are pivotable on the first and second switching element. However, it would also be possible for the force coupling elements to be balls which can roll on the first and second switching element. For this purpose the switching element might exhibit guide elements for the balls.

The force coupling elements are situated between the first and second switching element and the first and second switchable element. Therein it would however also be possible for the force coupling elements to be partially integrated into the first or second switching element and preferentially to protrude there from, in particular in the direction of the switchable element.

The magnetisable segments are magnetisable area segments which are in the form of magnetic sheets. These magnetic sheets may for example be integrated into a copper disc with recesses, as mentioned above. Also, the magnetisable area segments might be integrated into a plastic block, for example a plastic disc.

The permanent magnets of the pole element are located at a distance from each other. Therein the magnets can, for example, be located at a distance from each other along the circumferential direction. It would, however, also be possible for them to be located at a distance from each other in a longitudinal direction. In a further advantageous embodiment, the magnets are NdFeB magnets. These magnets exhibit very high magnetic forces.

The pole element is rotatable about a defined axis of rotation. The force coupling elements are mounted so as to be pivotable about an axis on the first switching element and the second switching element. The pivoting movement of the coupling elements is synchronized on the first switching element and on the second switching element with respective synchronizing means. The synchronizing means can be purely mechanical. The synchronizing means can be purely electrical. Servo-motors are used to initiate the pivoting movement of the coupling elements. The synchronizing means may be a combination of mechanical and electrical as well.

As mentioned above, the force coupling elements are arranged on opposite sides of the pole element. The synchronized pivoting motion of the force coupling elements causes a rotation of the pole element. The number of coupling elements on either side of the pole element should be greater than two. The force coupling elements are movable in a plane in which the pole element rotates relative to the first switching element and the second switching element. The magnetisable force coupling elements are spatially separated from each other. Each of the magnetisable force coupling elements can carry in addition a magnetisable segment.

The magnetisable segments can be in the form of magnetic sheets which are provided on the force coupling elements. According to another embodiment the magnetisable segments are movably mounted on the force coupling elements. The direction of movement of the magnetisable segments is in a plane perpendicular to the axis of rotation of the pole segment. The invention furthermore extends to an electric circuit with a switching device as described above. It would, however, also be possible to use the switching device as a mechanical switching element and thus in particular without electrical connection.

BRIEF DESCRIPTION OF THE DRAWINGS

Further advantages and embodiments are clear from the accompanying drawings, in which.

DETAILED DESCRIPTION OF THE INVENTION

Figure 1:
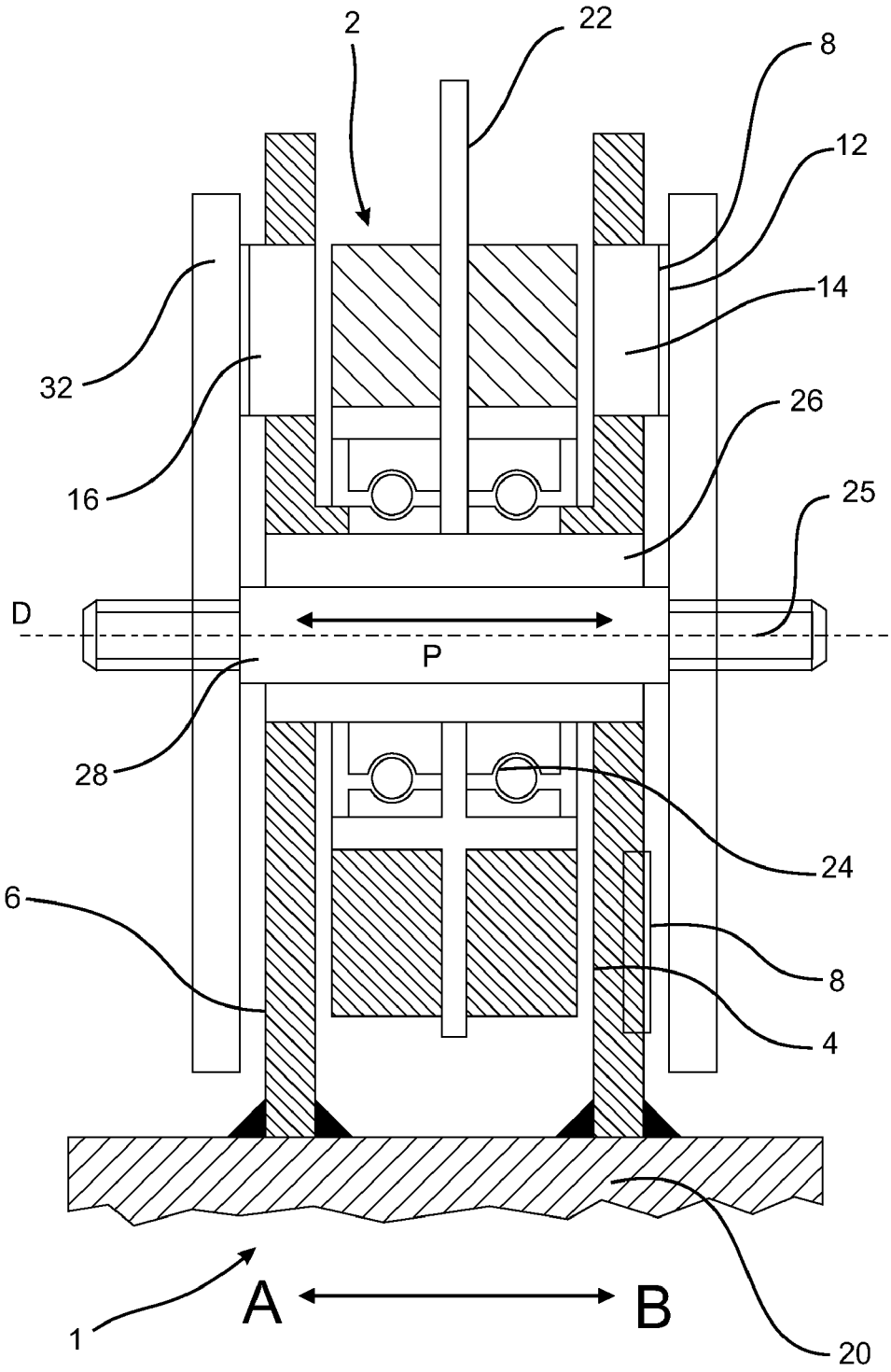
FIG. 1 is a schematic side view of a switching device according to the invention.

Identical reference numerals are used for like elements or elements of like function. For the sake of clarity only those reference numerals are shown in the figures which are necessary for the description of the respective figure. The embodiments shown are only examples of how the switching device according to the invention may be implemented; the scope of the invention is not limited to the embodiments shown.

FIG. 1 shows a schematic representation of a switching device 1 according to the invention. This switching device 1 therein exhibits a pole element 2, which is mounted on bearings 24 in such a way as to be rotatable with respect to a casing 26. This pole element 2 exhibits a plurality of permanent magnets located with alternating polarity in the circumferential direction. The reference numeral 22 refers to a lever for rotating the pole element about the axis of rotation D.

A first switching element 4 is located next to the pole element 2. The first switching element 4 therein is stationary relative to a substrate 20. The first switching element 4 exhibits (not shown) area segments. Depending on the relative position or rotary position of the pole element 2 with respect to the first switching element 4 the magnetic forces of the individual magnets of the pole element 2 either are short-circuited or, in this case, are transmitted to the right. In the case of no short-circuit the switchable element 12, for example an iron disc, is attracted by the pole element 2 or the first switching element 4, respectively, and thus moves to the left in FIG. 1. By this movement, an electrical switching process can be triggered. The switchable element 12 thus is movable along the double arrow P, i.e., parallel to the axis D.

A second switching element 6 is located on the opposite side with respect to the first switching element 4. Put differently, the pole element 2 is situated between the first switching element 4 and the second switching element 6. This second switching element 6 also exhibits magnetisable area segments 16, which are located in or at non-magnetisable areas. The second switching element 6 is rotated relative to the first switching element 4 by half a step with respect to these area segments 16.

This implies that in dependence on the rotary position of the pole element 2 relative to the first and second switching element 4 and 6 there is a magnetic short-circuit in precisely one of the switching elements 4, 6 and that in the other the magnetic force is transmitted.

This implies that in dependence on the rotary position of the pole element 2 both the switchable elements 12 and 32 move to the right or to the left along the double arrow P, depending on the rotary position. It is pointed out that the two switchable elements 12 and 32 preferentially are rigidly connected with each other in direction of the double arrow P. It would, however, also be possible for the two switching elements 4 and 6 to be movable independently of each other. Also spring elements could be provided, which bias the switching element or switching elements to a defined position (along the axis of rotation D).

Reference numeral 8 in its entirety schematically refers to a force coupling element, which is movable relative to the first switching element 4. A plurality of such force coupling elements 8 may be provided in circumferential direction on the first switching element 4 and if applicable correspondingly on the second switching element 6.

Depending on the position between the pole element 2 and the switching element 4 also said force coupling element 8 moves and in this way effects either a magnetic short-circuit or a transmission of the magnetic force, so that a rotary motion of the pole element 2 relative to the switching element 4 becomes easier.

Both the switchable elements 12 and 32 therein are arranged on a shaft 25. The casing 28 is situated between the two switchable elements 12 and 32, and thus determines the distance between these two switchable elements 12 and 32, and thus also the switching travel which can be achieved by rotating the pole element 2.

Figure 2:
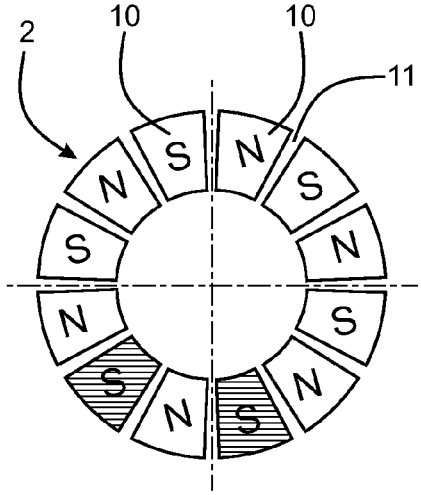
FIG. 2 is a top view of a pole element.

FIG. 2 shows a top view of a pole element 2. Here it is clear that this pole element 2 exhibits a plurality of magnetic elements 10, located with alternating polarities one next to the other in circumferential direction. Advantageously, and, in particular, non-magnetic gap 11 is formed between these individual magnetic elements 10.

Figure 3:
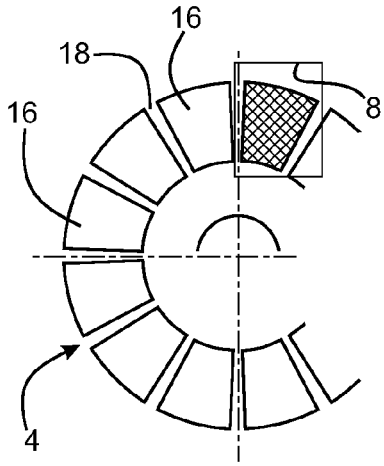
FIG. 3 is a top view of a switching element with force coupling elements.

FIG. 3 shows a representation of a switching element 4, which here exhibits a plurality of magnetisable area segments 16. These magnetisable area segments 16 here are separated from each other by non-magnetisable intermediate spaces 18.

Advantageously, these area segments 16 are congruent with the cross sections of the individual magnets 10 of the pole element 2. If these area segments 16, depending on the rotary position, essentially are located over the cross sections of the magnets 10, the magnetic force is transmitted and in this way a magnetic or magnetisable (switchable) element can be attracted. If the area segments 16 are rotated by half a step relative to the pole element 2, a magnetic short-circuit of each of the individual magnetic forces of the magnets 10 occurs, so that no magnetic force results and thus a corresponding switchable element 12 (FIG. 1) is not attracted.

Reference numeral 8 rather schematically indicates a force coupling element, which is movable relative to the corresponding area segment 16 and thus also relative to the switching element 4.

FIGS. 4A-4D and 5A-5D illustrate an advantageous embodiment of a switching device according to the invention. In this embodiment a plurality of balls 8 is provided on the switching element 4 (see FIG. 4A). These balls 8 therein can move in a radial direction R, wherein for this purpose dividers 42 are provided, which also extend in radial direction and between which intermediate spaces 44 are formed, into which the balls 8 can move. FIG. 4B again shows the pole element 2 with, in circumferential direction, alternatingly polarized magnets.

Figure 4A:
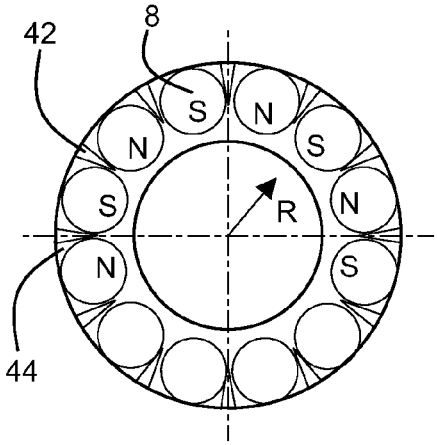
FIGS. 4A-4D illustrate an embodiment of a switching element with force coupling elements in various states.
Figure 4B:
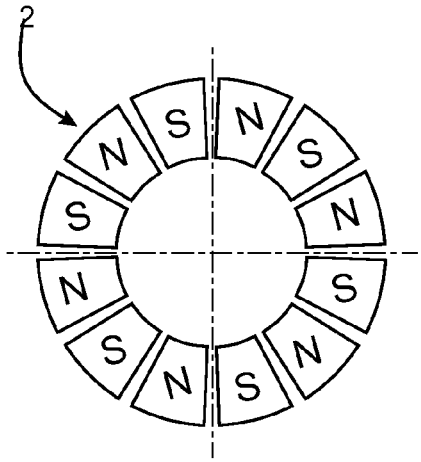
Figure 4C:
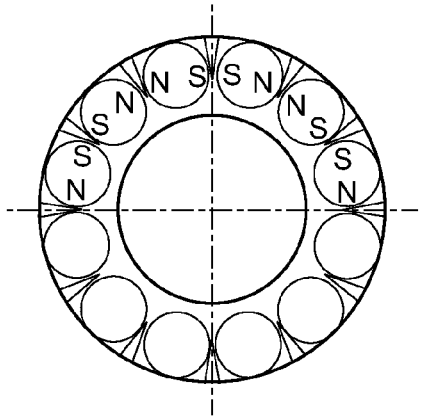

If the switching element 4 shown in FIG. 4A is located in this position over the pole element 2 of FIG. 4B, the balls 8 remain in the position shown in FIG. 4A, as here only the magnetic forces of the magnetic poles are transmitted. More precisely, the magnetic field is transmitted to the switchable elements 12 or 32, respectively, through the balls 8. This situation is shown in FIG. 4A. In this position the balls 8 preferentially do not yet touch each other, as this is prevented by the dividers 42. For this reason there also occurs no magnetic short-circuit yet.

Figure 5A:
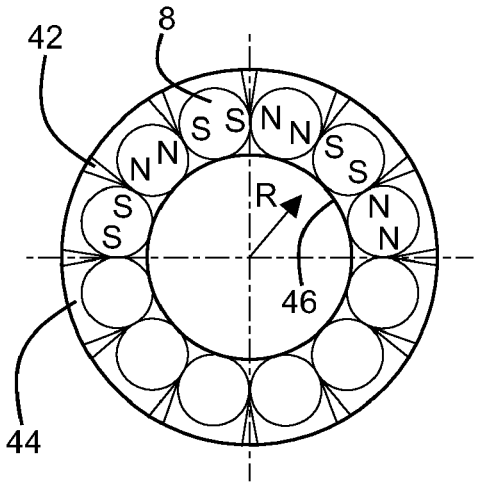
FIGS. 5A-5D illustrate a further schematic view of the embodiment.
Figure 5B:
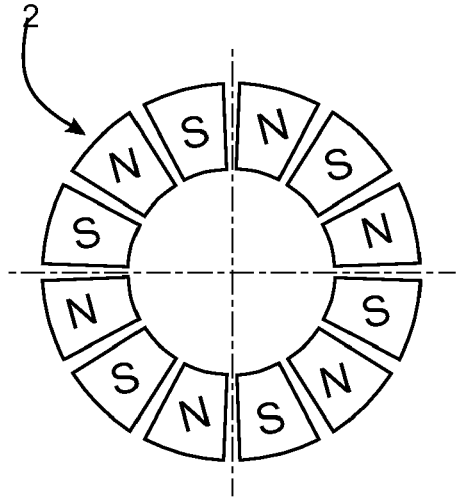
Figure 5C:
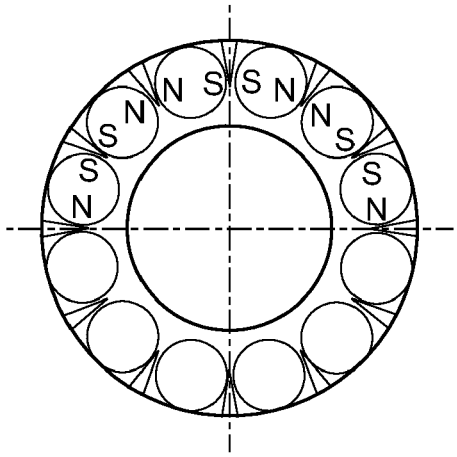
Figure 5D:
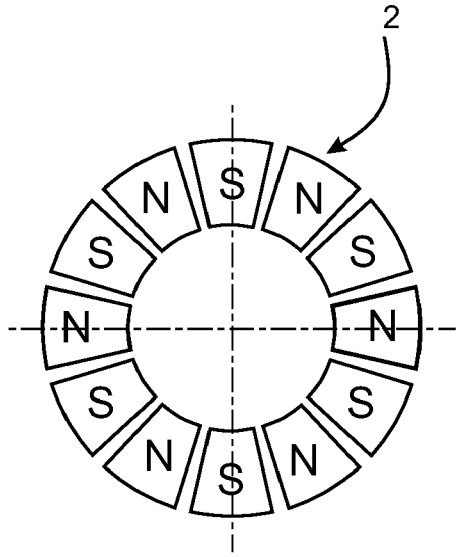

In this situation the respective switchable element 12 or 32 is attracted very closely to the balls 8. In the strong magnetic field generated the balls 8 start attracting each other and thus migrate to the inner circular ring 46, as shown in FIG. 5A. In this position the balls 8 touch each other and establish a magnetic short-circuit over all the poles. In this way the switchable element 12, 32 is released in position A (see FIG. 1), so that switching can be done more easily, the switching process thus is made easier. In the situation shown in FIG. 5A the balls 8 do not yet touch necessarily or completely. In this situation it is also possible that some of the balls 8 are still farther outwards in the radial direction R, so that a magnetic short-circuit is at least not yet established over the entire circumference.

Figure 4D:
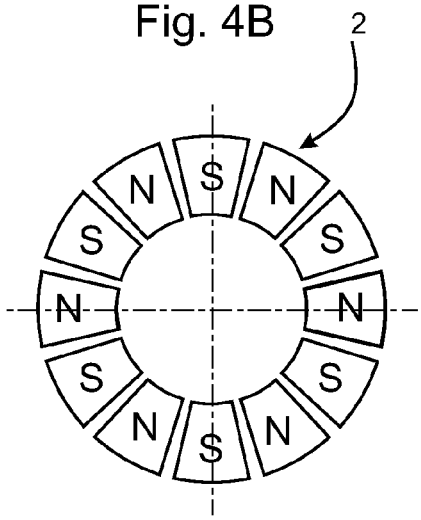

If on the other hand the pole element 2, as shown in FIG. 4D, has been rotated by half a turn (see FIGS. 4C and 5C), the individual force coupling elements 8, i.e., the balls, are magnetized in such a way that they repel each other. Due to this repulsion, the balls 8 migrate outwards. For this reason the magnetic short-circuit at the respective switching element 4, 6 is maintained (see FIGS. 4A, 5C).

During a subsequent rotation of the pole element 2 the area segments of the respective switching element 4, 6 are rotated directly over the poles of the pole element 2 and the initial configuration of FIG. 4A results. Thus also in this case the forces or angular momenta, respectively, required for rotating the pole element 2, are reduced.

Instead of balls also cylindrical rolls, for example, may be provided, it would also be possible to provide sliding elements or the like. Also, the individual force coupling elements need not necessarily be moved in the radial direction relative to the switching element 4 or 6, this is advantageous, however. In the situation shown in FIG. 4A it is advantageous for the balls 8 not to touch each other.

It would, however, also be possible for a plurality of force coupling elements 8 to be pivoted on the switching element 4, 6. For this purpose a plurality of pivots could be provided on the switching elements 4, 6, each pivot being an axis for pivoting the force coupling elements 8.

Figure 6:
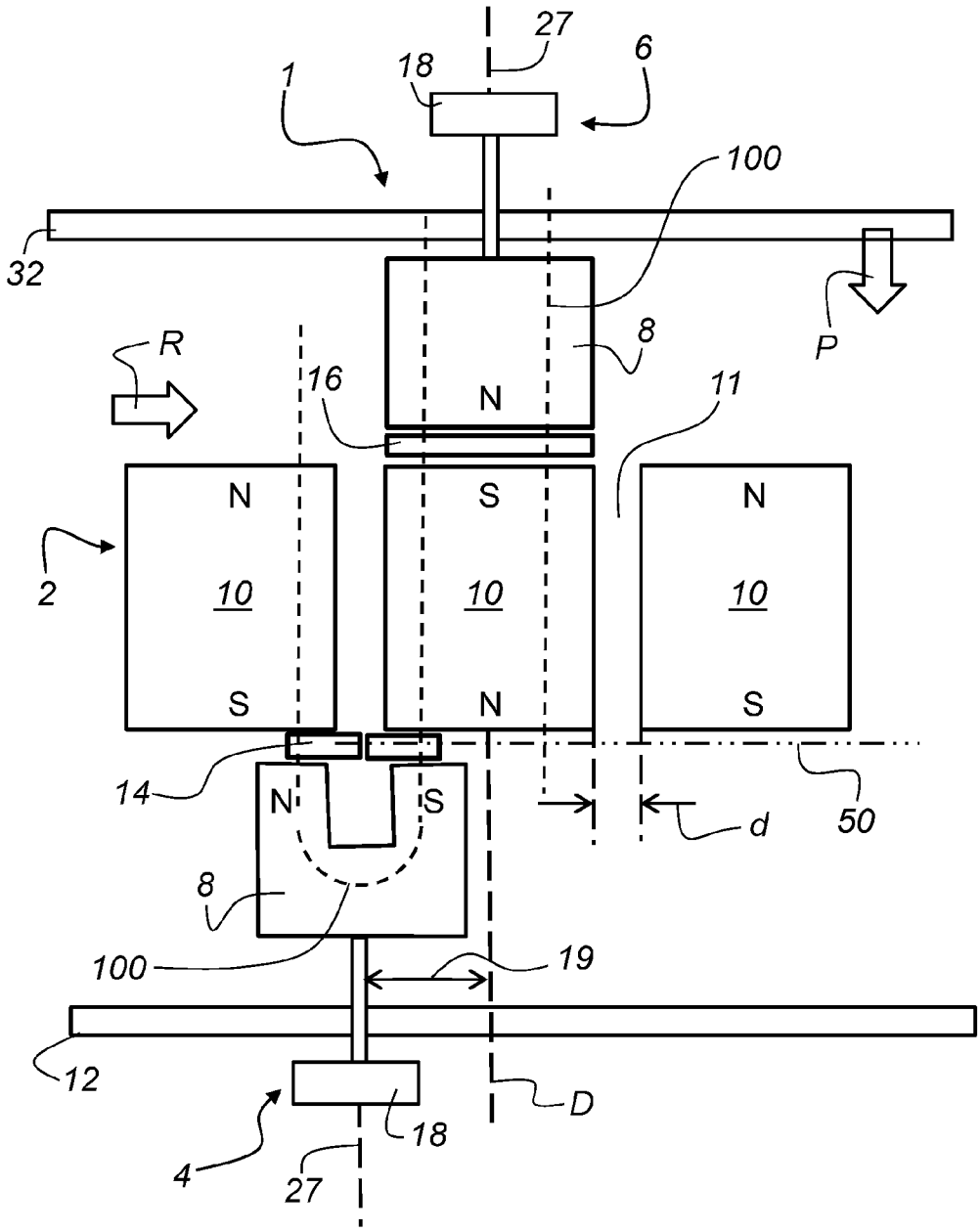
FIG. 6 is a schematic side view of the switching device according to the invention, wherein the arrangement of the force coupling elements in relation to the pole element is shown.

FIG. 6 shows a schematic side view of the switching device 1 according to the invention. Force coupling elements 8 are arranged in relation to the pole element 2. FIG. 6 shows one force coupling element 8 on either side of the pole element 2. This should be not considered as a limitation of the present invention. It is absolutely clear that numerous force coupling element 8 are arranged on either side of the pole element 2. The switching device has a ring shaped pole element 2. The pole element itself has a plurality of permanent magnets 10 which are in the shape of a segment of a circle. The magnets 10 are arranged one next to the other with alternating polarity and are located at a distance d from each other. At least one first switching element 4 and at least one second switching element 6 are arranged such that the pole element 2 is situated between them. The first switching element 4 and the second switching element 6 are arranged so as to be pivotable around axis 27 relative to the pole element 2.

The permanent magnets 10 are in the shape of a segment of a circle and are separated from one another by non-magnetic gaps 11. Each of the first switching element 4 and the second switching element 6 exhibit at least two magnetisable force coupling elements 8, wherein the first switching element 4 and the second switching element 6 are arranged such in relation to the pole element 2 that the first switching element 4 and the second switching element 6 are separated by half a step 19 in a direction of rotation R of the pole element 2. Each of the magnetisable force coupling elements 8 carries a magnetisable segment 14 or 16. In FIG. 6 the force coupling element 8 of the first switching element 4 is located right above a non-magnetic gap 11 of two consecutive permanent magnets 10. The force coupling element 8 of the first switching element 4 short-circuits the magnetic flux 100 and the magnetic field lines do not induce a magnetic field in the first switchable element 12 or exert any magnetic force on the first switchable element 12.

On the other hand, the force coupling element 8 of the second switching element 6 is positioned directly above a permanent magnet 10 of the pole element 2. Additionally, the force coupling element 8 is pivoted 90° about axis 27. The force coupling element 8 of the second switching element 6 transmits the magnetic flux 100 and consequently the magnetisable second switchable element 32 is attracted in the direction of arrow P.

In order to enhance the magnetic force exerted by the force coupling elements 8, magnetisable segments 14 or 16 are provided on the force coupling elements 8 directly opposite the pole element 2. According to one embodiment of the invention, the magnetisable segments 14 or 16 are magnetic sheets which are provided on the force coupling elements 8. According to the embodiment, shown in FIG. 6, the magnetisable segments 14 and 16 are mounted so as to be movable on the force coupling elements 8. The magnetisable segments 14 and 16 move in a plane 50 perpendicular to the axis of rotation D.

Synchronizing means 18 are provided with the first switching element 4 and the second switching element 6 in order to synchronize the pivoting movement of the force coupling elements 8 on the first switching element 4 and the second switching element 6.

Figure 7A:
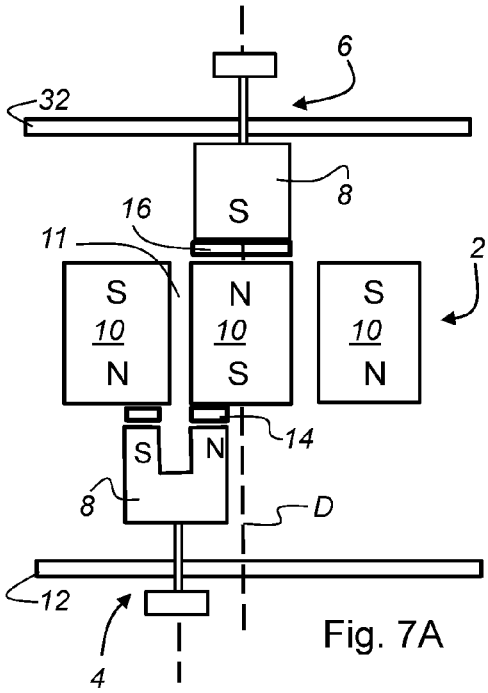
FIGS. 7A-7D illustrate various steps of the rotational motion of the pole element, wherein the rotational motion is initiated by the position of the force coupling elements.
Figure 7B:
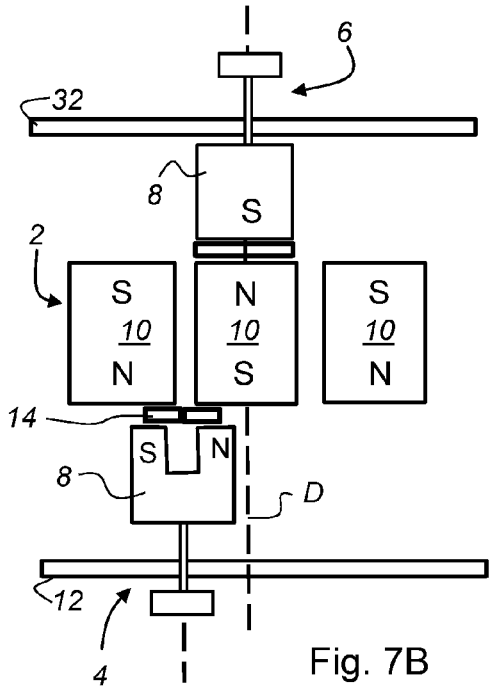

FIGS. 7A-7D show the various steps of the rotational motion of the pole element 2. The rotational motion is initiated by the position of the force coupling elements 8 of the first switching element 4 and the second switching element 6. FIGS. 7A and 7B show the situation wherein the force coupling element 8 of the second switching element 6 is located directly above one of the permanent magnets 10 of the pole element 2. A magnetisable segment 16 is mounted to the force coupling element 8 in order to enhance the magnetic effects. The force coupling element 8 of the first switching element 4 is bridging the gap 11 between two permanent magnets 10 of the pole element 2. A magnetisable segment 14 is mounted to the force coupling element 8 in order to enhance the magnetic effects. The force coupling element 8 of the first switching element 4 short-circuits the magnetic flux and as shown in FIG. 7B the magnetisable segments 14 on the force coupling element 8 of the first switching element 4 attract each other. As a result the magnetisable second switchable element 32 is attracted.

Figure 7C:
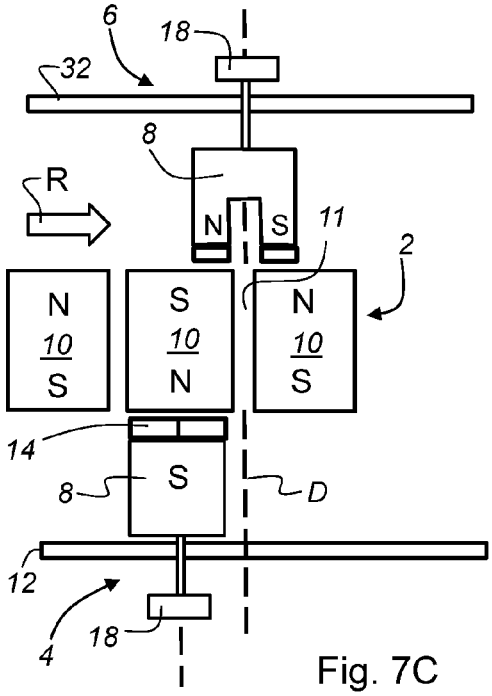
Figure 7D:
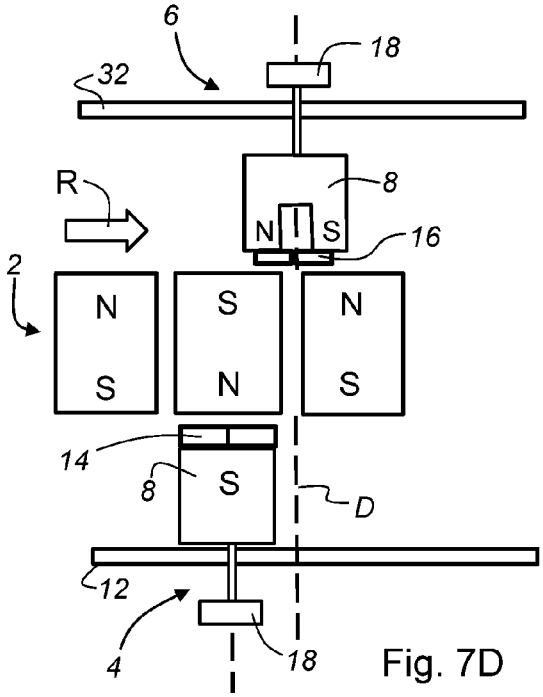

FIGS. 7C and 7D show the situation that the synchronizing means 18 have pivoted the force coupling elements 8 of the first switching element 4 and the second switching element 6. Parallel to the pivoting motion of the force coupling elements 8 the pole element 2 rotates in the direction R. As shown in FIG. 7C, the force coupling element 8 of the second switching element 6 is bridging the gap 11 between two permanent magnets 10 of the pole element 2. On the other hand, the force coupling element 8 of the first switching element 4 is located directly above one of the permanent magnets 10 of the pole element 2. A magnetisable segment 14 is mounted to the force coupling element 8 in order to enhance the magnetic effects. The force coupling element 8 of the first switching element 4 transmits the magnetic flux and thus the first switchable element 12 is attracted. In FIG. 7D the magnetisable segments 16 on the force coupling element 8 of the second switching element 6 attract each other and therefore short-circuit the magnetic flux.

Figure 8:
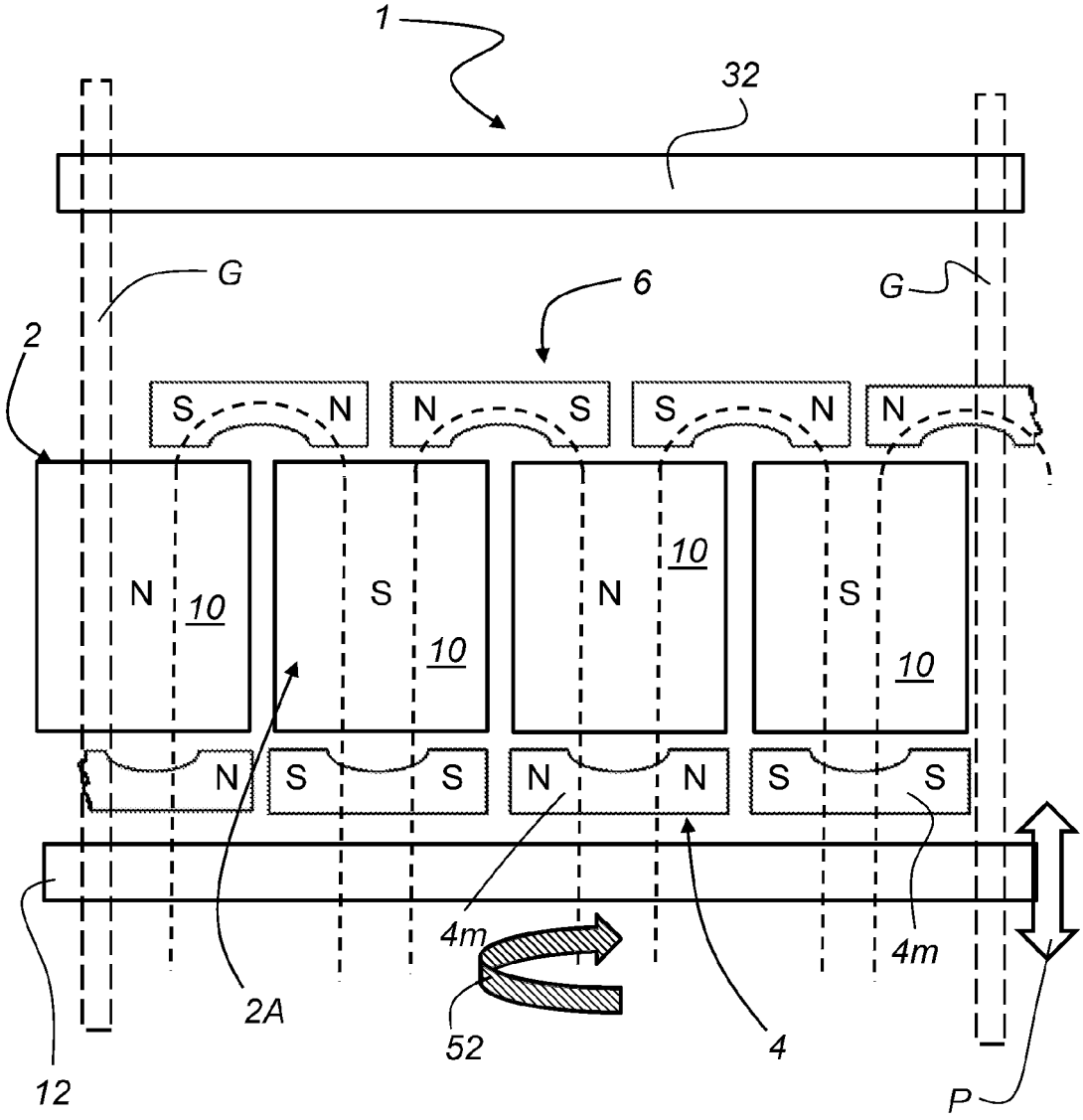
FIG. 8 is a schematic view of a further embodiment of the switching device according to the invention in a first switching mode; and, FIG. 9 is a schematic side view of the embodiment shown in FIG. 6 in a second switching mode.
Figure 9:
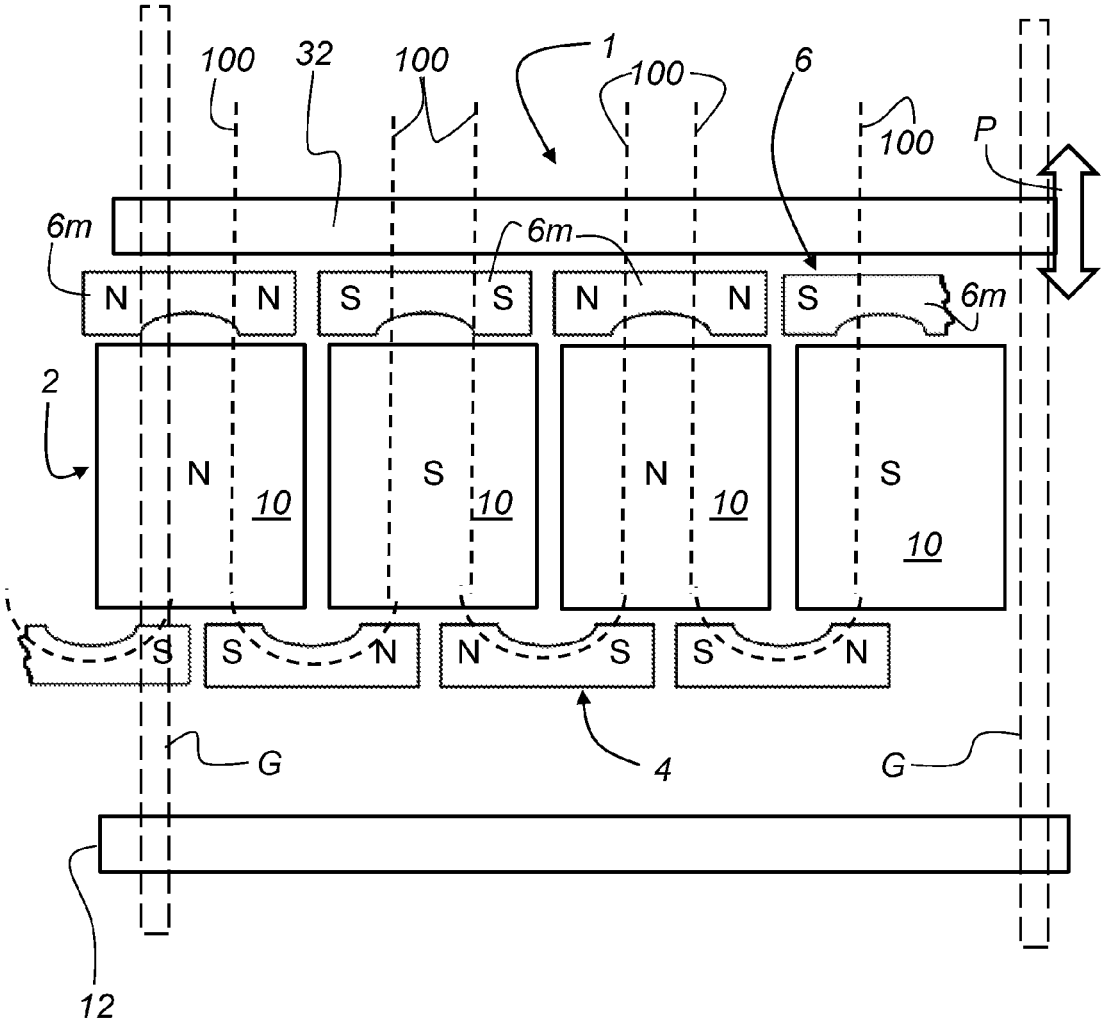

FIG. 8 and FIG. 9 show a further embodiment of the inventive switching device 1. Different switching modes are shown in FIG. 8 and FIG. 9, respectively. This switching device 1 therein exhibits a pole element 2, which is mounted on bearings (not shown here) in such a way as to be rotatable. The view in FIG. 8 is onto a lateral area 2A of the pole element 2. This pole element 2 exhibits a plurality of permanent magnets 10 located alternating in the circumferential direction. The pole element is rotatable as indicated in FIG. 8 by arrow 52 (the axis of rotation is not shown).

A first switching element 4 is located next to the pole element 2. The first switching element 4 is a disk-shaped element which carries a plurality of magnetic elements 4*m*. The first switching element 4 exhibits (not shown) area segments. Depending on the relative position or rotary position of the pole element 2 with respect to the magnetic elements 4*m* of the first switching element 4 the magnetic forces of the permanent magnets 10 of the pole element 2 either are short-circuited or, in this case transmit the magnetic field lines 100. In the case of FIG. 8 the switchable element 12, for example an iron disc, is attracted by the pole element 2 in cooperation with the first switching element 4. By this movement an electrical switching process can be triggered. The switchable element 12 thus is movable along the double arrow P, i.e., along guides G.

FIG. 9 shows a second switching mode of the switching device 1. The second switching element 6 is located on the opposite side with respect to the first switching element 4. The pole element 2 is situated between the first switching element 4 and the second switching element 6. This second switching element 6 is a disk-shaped element which carries a plurality of magnetic elements 6*m*. The second switching element 6 is rotated relative to the first switching element 4 by half a step with respect to the magnetic elements 4*m* and 6*m*.

This implies that in dependence on the rotary position of the pole element 2 both the switchable elements 12 and 32 move, as shown in the drawing up or down, depending on the rotary position. It is pointed out that the two switchable elements 12 and 32 preferentially are rigidly connected with each other in direction of the double arrow P. Depending on the relative position or rotary position of the pole element 2 with respect to the magnetic elements 6*m* of the second switching element 6 the magnetic forces of the permanent magnets 10 of the pole element 2 either are short-circuited or, in this case, transmitted. The switchable element 32 is attracted and moves in direction of the double arrow P.

The switching of the switchable elements 12 and 32 is carried out in an alternating manner, depending on the relative position of the pole element with respect to switching elements 4 and 6.

All features disclosed in the application are claimed as relevant to the invention, as far as they, individually or in combination, are novel with respect to prior art.

LIST OF REFERENCE NUMERALS

1 switching device
2 pole element
2A lateral area of pole element
4 first switching element
4*m* magnetic element
6 second switching element
6*m* magnetic element
8 force coupling element, balls
10 permanent magnet
11 non-magnetic gap
12 first switchable element
14 magnetisable segment
16 magnetisable segment
18 synchronizing means
19 half a step
20 substrate
22 lever
24 bearing
25 shaft
26 casing
27 axis
32 second switchable element
42 dividers
44 intermediate spaces
50 plane
52 arrow
100 magnetic field lines
G guides
P direction
d distance
R direction of rotation
D axis of rotation

What is claimed is:

1. A switching device, comprising:

a ring shaped pole element having a plurality of permanent magnets in the shape of a segment of a circle and arranged one next to another with alternating polarity and are separated from one another by non-magnetic gaps;

at least one first switching element;

at least one second switching element, wherein the pole element is situated between the at least one first switching element and the at least one second switching element and being rotatable relative to the at least one first switching element and the at least one second switching element; and, a magnetisable force coupling element is provided with each of the at least one first switching elements and the at least one second switching elements, wherein the first switching element and the second switching element are arranged such in relation to the pole element that the first switching element and the second switching element are separated by half a step in a direction of rotation of the pole element and the force coupling elements are movable in a plane in which the pole element moves.

2. The switching device recited in claim 1, wherein the pole element moves relative to the first switching element and the second switching element.

3. The switching device recited in claim 1, wherein the magnetisable force coupling elements are separated from each other by half a step in a direction of rotation of the pole element.

4. The switching device recited in claim 3, wherein the magnetisable segments are magnetic sheets provided on the force coupling elements.

5. The switching device recited in claim 3, wherein the magnetisable segments are mounted on the force coupling elements and are movable in a plane perpendicular to the axis of rotation.

6. The switching device recited in claim 1, wherein each of the magnetisable force coupling elements carries a magnetisable segment.

7. The switching device recited in claim 1, wherein the pole element has a defined axis of rotation.

8. The switching device recited in claim 1, wherein the force coupling elements are mounted so as to be pivotable about an axis on the first switching element and the second switching element, respectively.

9. The switching device recited in claim 8, wherein synchronizing means are provided to synchronize the movement of the force coupling elements on the first switching element and the second switching element.

10. The switching device recited in claim 9, wherein the synchronizing means is purely mechanical.

11. The switching device recited in claim 9, wherein the synchronizing means is purely electrical.

12. The switching device recited in claim 1, wherein the first switching element and the second switching element are stationary.

13. The switching recited in claim 1, wherein the magnets are located at a distance from each the previous other.

14. The switching device recited in claim 1, wherein the magnets are NdFeB-magnets.

15. A switching device, comprising:

a ring shaped pole element having a plurality of permanent magnets in the shape of a segment of a circle and arranged one next to another with alternating polarity and are separated from one another by non-magnetic gaps;

at least one first switching element;

at least one second switching element, wherein the pole element is situated between the at least one first switching element and the at least one second switching element and being rotatable relative to the at least one first switching element and the at least one second switching element; and, a magnetisable force coupling element is provided with each of the at least one first switching elements and the at least one second switching elements, wherein the force coupling elements are arranged such in relation to the pole element that force coupling elements on either side of the pole element are separated by half a step in a direction of rotation of the pole element and the force coupling elements pivotable about an axis relative to the rotation of the pole element.

16. A switching device, comprising:

a ring shaped pole element having a plurality of permanent magnets in the shape of a segment of a circle and arranged one next to another with alternating polarity and are separated from one another by non-magnetic gaps;

at least one first switching element;

at least one second switching element, wherein the pole element is situated between the at least one first switching element and the at least one second switching element and being rotatable relative to the at least one first switching element and the at least one second switching element; and, a magnetisable force coupling element is provided with each of the at least one first switching elements and the at least one second switching elements, wherein the first switching element and the second switching element are arranged such in relation to the pole element that the first switching element and the second switching element are separated by half a step in a direction of rotation of the pole element and the force coupling elements are pivotable about an axis relative to the rotation of the pole element.

* * * * *